US006161988A

United States Patent [19]

Pawluk

[11] Patent Number: 6,161,988

[45] Date of Patent: Dec. 19, 2000

[54] METHOD AND APPARATUS FOR MAINTAINING A GOLF COURSE WATER HAZARD FREE OF DEBRIS

[76] Inventor: Laura-Anne Jean Pawluk, 36 Ramblewood Drive, Toronto, Ontario, Canada, M1C 3E1

[21] Appl. No.: 09/033,068

[22] Filed: Mar. 2, 1998

[51] Int. Cl.[7] ..... E02B 8/02

[52] U.S. Cl. ..... 405/74; 473/197

[58] Field of Search ..... 405/15, 16, 53, 405/60, 63, 67, 74; 4/498, 501, 504; 43/7, 8, 14; 473/157, 197

[56] References Cited

U.S. PATENT DOCUMENTS

| | | | |
|---|---|---|---|
| 1,091,909 | 3/1914 | Birmingham . | |
| 1,796,762 | 3/1931 | Paston . | |
| 3,092,844 | 6/1963 | Brunson | 4/504 |
| 3,380,592 | 4/1968 | Arnold . | |
| 3,413,661 | 12/1968 | Ross . | |
| 3,649,025 | 3/1972 | Garland | 473/157 |
| 3,780,385 | 12/1973 | Dunn . | |
| 3,815,279 | 6/1974 | Poirot . | |
| 3,830,004 | 8/1974 | Poirot . | |
| 3,905,143 | 9/1975 | Poirot . | |
| 4,129,905 | 12/1978 | Niemirow . | |
| 4,888,842 | 12/1989 | McKamey et al. . | |
| 5,240,246 | 8/1993 | Gohil et al. | 473/197 |
| 5,453,190 | 9/1995 | Martin, Sr. | 43/7 |
| 5,540,521 | 7/1996 | Biggs . | |

FOREIGN PATENT DOCUMENTS

| | | |
|---|---|---|
| 4136976 | 5/1993 | Germany . |

*Primary Examiner*—Eileen D. Lillis
*Assistant Examiner*—Frederick L. Lagman
*Attorney, Agent, or Firm*—Riches, McKenzie & Herbert

[57] ABSTRACT

An apparatus used to maintain the bottom surface of a wishing well, fountain, pond, stream or other water body substantially free of debris, such as litter, unwanted plant life and/or golf balls includes a flexible mesh sized to overlie at least part of the bottom of the water body, and a lifting mechanism which is used to lift the mesh from the water. A peripheral edge portion of the mesh is secured adjacent an edge bank of the water body by anchors, with the lifting mechanism is positioned to engage and lift a portion of the mesh remote from the secured edge portion between a submerged position and a raised position above the water surface.

16 Claims, 3 Drawing Sheets

METHOD AND APPARATUS FOR MAINTAINING A GOLF COURSE WATER HAZARD FREE OF DEBRIS

SCOPE OF THE INVENTION

The present invention relates to an apparatus for maintaining a water body such as a well, pond, stream or fountain free of debris, and more particularly an apparatus operable to remove litter and unwanted reptiles and plant life from a golf course water hazard, and its method of use.

BACKGROUND OF THE INVENTION

The maintenance of golf course ponds and water hazards presents a challenge for greenskeepers. By their nature and purpose, golf course water hazards are positioned to entrap the golf balls of all but the most skilled golfers. As a result, a significant industry has developed in the reclamation and resale of golf balls from golf course streams and ponds. In addition, golf course water hazards are also susceptible to the accumulation of twigs, unwanted plant life and litter which creates an unsightly appearance, and which may detract from the overall favorable aesthetics of the golf course.

In an effort to maintain a pleasant golf course environment, greenskeepers periodically clean the bottom of ponds, streams and other such water hazards to remove debris such as golf balls, litter, twigs and any unwanted plant life which accumulates therein. Pond and stream cleaning is usually done manually by a scuba diver who enters the water hazard, and manually collects the debris from the pond or stream bottom.

Manual cleaning of golf course water hazards is both inefficient and time consuming. As well, the use of scuba equipment necessitates that the diver is wholly immersed in the water, which may possibly lead to infection or diseases if water borne bacteria is present, or even death in the event of equipment malfunction. In addition to the inherent dangers associated with the use of scuba equipment, in various areas in the southeast United States, the presence of alligators in golf course water hazards places the diver in further jeopardy.

SUMMARY OF THE INVENTION

The present invention seeks to overcome at least some of the disadvantages of the prior art by providing a flexible mesh liner adapted to overlie at least part of the bottom surface of a pond, stream, fountain, wishing well or other water body, and which may be raised from the water body at least in part, to permit easy collection and removal of any debris which has accumulated therein.

Another objective of the invention is to provide an apparatus which may be used to maintain the bottom surface of a pond or stream substantially free of debris such as litter and/or any unwanted plant life, without requiring a user to physically immerse him or herself in the pond or stream.

Another objective of the invention is to provide an apparatus for facilitating the removal of debris, such as golf balls, litter, and/or unwanted plant life, from golf course water hazards.

A further objective of the invention is to provide a flexible mesh liner for a pond or stream which has a mesh opening size selected to substantially prevent the movement of golf balls and litter therepast, while permitting substantially unrestricted water movement therethrough.

Another objective of the invention is to provide an apparatus for a golf course water hazard which is sized to overlie at least part of the bottom surface of the hazard, and lifting mechanism adapted to raise part of the mesh above the water hazard to a height to permit the easy removal of any debris, litter or golf balls which has collected thereon.

Another objective of the invention is to provide an apparatus which may be used to periodically disturb growing plant vegetation in a pond, stream or other water body, to substantially prevent unwanted plant life from taking root therein.

A further objective of the invention is to provide an apparatus used to lift debris from the bottom surface of a water body, and which includes a mesh which is movable between a submerged orientation substantially in overlying juxtaposition with the bottom surface of the water body, and a raised orientation where at least part of the mesh is lifted above the water surface to facilitate the collection of any debris thereon from an adjacent bank.

The present invention provides an apparatus used to maintain the bottom surface of a pond, fountain, wishing well, stream or other water body substantially free of debris, such as litter, unwanted plant life and/or golf balls. The apparatus includes a flexible mesh which is sized to overlie at least part of the bottom of the water body, and a lifting mechanism used to lift part, and preferably almost all of the mesh from the water. A peripheral edge portion of the mesh is secured adjacent an edge bank of the water body by anchors such as metal bars driven through the mesh into the ground, wire rope, weighted pavers placed over the edge of the mesh, or by other spikes or other fasteners configured to hold the edge of the mesh firmly in place. The lifting mechanism is positioned to engage and lift a portion of the mesh which is remote from the secured edge portion between a submerged position and a raised position above the water surface.

Numerous possible lifting mechanisms may be used with the present invention. In one simplified embodiment, the lifting mechanism includes a keeper member, such as a hook or clamp which releasably engages a coupling member secured either directly to the mesh, or to a pole or other mounting structure which in turn is fastened to the mesh. Suitable coupling members would therefore include hooks, rings, loops, lifting bars or any other structures suitable for coupling with the keeper member. The coupling member is secured to the mesh at a remote location spaced a distance from the secured edge portion, and most preferably at a location spaced towards the center of the water body. The keeper member may be mounted on a lift boom or beam and may be vertically movable to selectively raise and lower the remote portion of the mesh either by the operation of pulleys and wires, or by raising or lowering an end of the lift boom or beam. The lift boom can be either permanently mounted, or mounted on a vehicle or trailer for mobile deployment.

Once the keeper member is joined to the coupling member, the keeper member is raised, lifting with it both the coupling member and the portion of the mesh liner which is secured to the coupling member. The keeper member is raised to a height so that part and preferably almost all of the mesh is lifted above the surface of the water body. More preferably, the keeper member is used to raise the mesh above the water surface so that substantially all of the mesh is raised above and slopes towards the secured edge portion of the mesh. This advantageously permits any debris collected on the mesh to move towards its secured edge portion. Raising the mesh to such a position thereby facilitates any debris collected thereon to be washed, swept, vibrated or to move on its own toward the pond or stream edge, where it may be collected by an individual standing on the banks of the stream or pond.

Once the accumulated debris has been cleared from the surface of the mesh, the keeper member and coupling member are lowered, permitting the mesh to return under its own weight to the submerged position, and most preferably in overlying juxtaposition with the bottom of the stream or pond. If a mobile lifting mechanism is provided, the keeper member and coupling member may thereafter be uncoupled, and the lifting mechanism repositioned for use elsewhere.

Although a lift boom and keeper member may present one simplified lifting mechanism used to raise and lower the mesh, other lifting structures are also envisioned. Possible lifting mechanisms include the use of lift wires mounted on permanently positioned poles and telescoping pneumatic and/or hydraulic lift cylinders. In one such alternate embodiment, the portion of the mesh remote from the secured peripheral edge is coupled to a telescoping section of a hydraulic lift cylinder, and is vertically movable therewith. In a collapsed configuration, the telescoping section is preferably partially or wholly submerged beneath the surface of the pond or stream, so that substantially all of the mesh lies directly on the bottom of the water body. By extending the telescoping segments of the lift cylinders, the portion of the mesh which is remote from the secured edge is moved to the raised position, carried by the telescoping cylinders.

In a more elaborate construction, the telescoping members may be combined as part of a fountain construction, which, when fully extended, directs a water spray onto the mesh to assist in moving any accumulated debris towards the secured edge portion, and which when retracted, operates as a conventional water fountain.

Accordingly, in one aspect the present invention resides in an apparatus for maintaining a bottom surface of a pond or stream in a substantially debris free state, comprising, a flexible mesh sized to overlie at least part of said bottom surface, hold down means for securing an edge portion of said mesh adjacent to an edge of said pond or stream, lifting means for selectively raising a remote portion of said mesh which spaced from said edge portion from a submerged position wherein said mesh is substantially in juxtaposition with said bottom surface, and a raised position wherein said remote portion of said mesh is raised vertically from said pond or stream to a height to permit debris which has accumulated on the mesh to be moved away from the raised remote portion in a direction towards the mesh edge portion.

In another aspect, the present invention resides in a golf course water hazard liner for maintaining a bottom surface of a water hazard substantially free of debris, comprising, a flexible mesh sized to overlie at least part of said bottom surface, wherein said mesh is characterized by mesh openings having a size which permit substantially unrestricted movement of water therethrough while preventing the passage of golf balls therethrough, said mesh having a peripheral edge portion permanently secured adjacent to an edge of said water hazard, means for selectively moving a remote portion of said mesh which is spaced from said edge portion between a submerged position wherein said mesh is substantially in juxtaposition with said bottom surface, and a raised position wherein said remote portion is raised vertically relative to said edge portion sufficiently to lift substantially all of the mesh from the water.

In a further aspect, the present invention resides in a method of maintaining a bottom surface of a golf course water hazard free of golf balls, weeds or litter by the use of a liner comprising, a flexible mesh sized to overlie at least part of said bottom surface, an edge portion of said mesh being secured adjacent to an edge of said water hazard, lifting means for selectively moving a remote portion of said mesh which is spaced from said edge portion between a submerged position where said mesh is substantially in juxtaposition with said bottom surface, and a raised position where said remote portion is raised vertically above said pond or stream to a height to permit any debris which has accumulated on the surface of the mesh to move from the raised remote portion towards the edge portion, said method comprising the steps of:

activating said lifting means to move said remote portion of said mesh to said raised position, removing any debris which accumulates towards the edge portion, and activating said lifting means to lower said remote portion of said mesh to said submerged position substantially in juxtaposition with said bottom surface.

BRIEF DESCRIPTION OF THE DRAWINGS

In order that the invention may be more readily understood, a preferred embodiment of the invention and variations thereof is described by way of example with reference to the accompanying drawings in which.

DETAILED DESCRIPTION OF THE INVENTION

Figure 2:
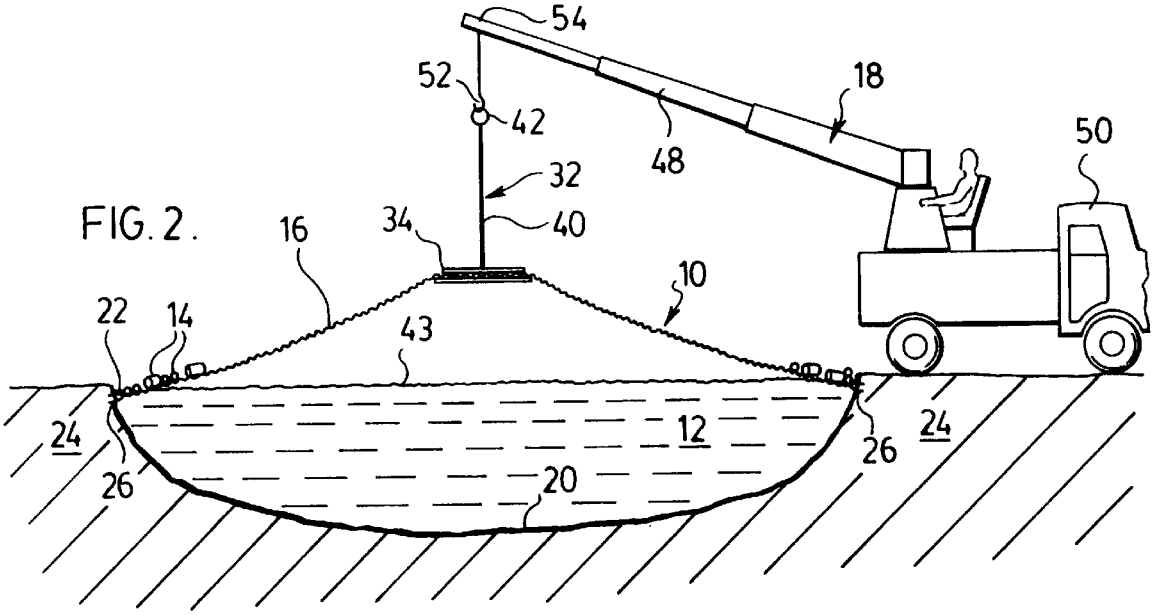
FIG. 2 shows a partial side view of the apparatus shown in FIG. 1 with the mesh liner in a fully raised position positioned substantially above the pond surface.

Reference is now made to FIG. 2 which shows an apparatus 10 which is used to maintain a golf course pond 12 or other golf course water hazard substantially free of golf balls, litter, twigs, leaves and other such debris 14. FIG.

Figure 1:
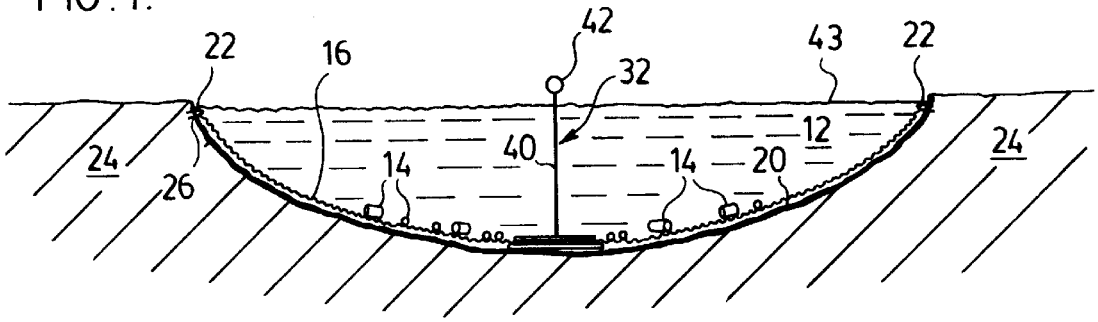
FIG. 1 shows a partial side view of an apparatus for maintaining a golf course pond free of debris in accordance with a first embodiment, and in which a mesh pond liner is shown in a fully submerged position.

2 shows best the apparatus 10 as including a flexible mesh liner 16 which is sized so as to substantially overlie the entire bottom surface 20 of the pond 12 as is shown in FIG. 1, and a lifting assembly 18 which, as will be described, is used to raise and lower the mesh liner 16 in the pond 12.

The mesh liner 16 is secured along its entire peripheral edge 22 by a series of spaced V or U-shaped steel anchors 26. The tines of the U-shaped anchors 26 are inserted through the mesh openings 30 (FIG. 4) and driven into the ground along the banks 24 of the pond 12, permanently securing the peripheral edge 22 of the mesh liner 16 and preventing its lateral shifting.

Preferably, the mesh liner 16 is formed having the same general configuration as the bottom surface 20, so that its peripheral edge 22 extends, at most, only marginally onto the pond banks 24, where it may otherwise present an impedance to golf course play. The mesh liner 16 is formed from a corrosive resistant material selected to ensure that the liner 16 maintains both tensile integrity, and flexibility over extended periods of use. Suitable materials used in the manufacture of the mesh liner 16 would therefore include corrosive resistant metals and alloys, stainless steel, either reinforced or unreinforced nylon, rubber and plastics, although coated wire mesh may also be used.

Figure 4:
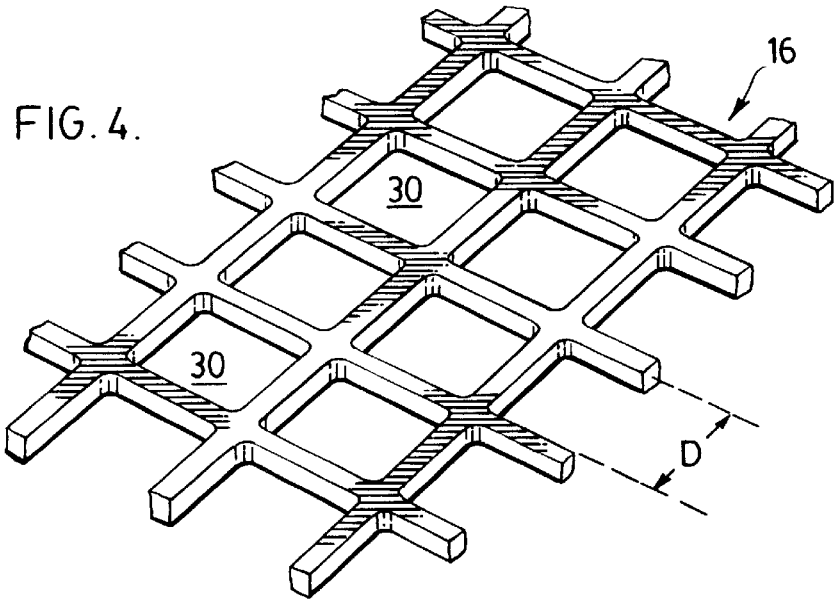
FIG. 4 shows an enlarged partial perspective view of the mesh liner used in the apparatus shown in FIG. 1.

FIG. 4 shows a preferred mesh configuration wherein the mesh liner 16 is provided with a series of generally square openings 30. Each opening 30 has an elongated dimension D which is selected large enough to permit substantially unrestricted flow of water through the mesh liner 16, while preventing passage of golf balls, litter, twigs or the like. Preferably, the mesh openings 30 have an elongated dimension D selected at between approximately ½ to 1 inch.

Figure 3:
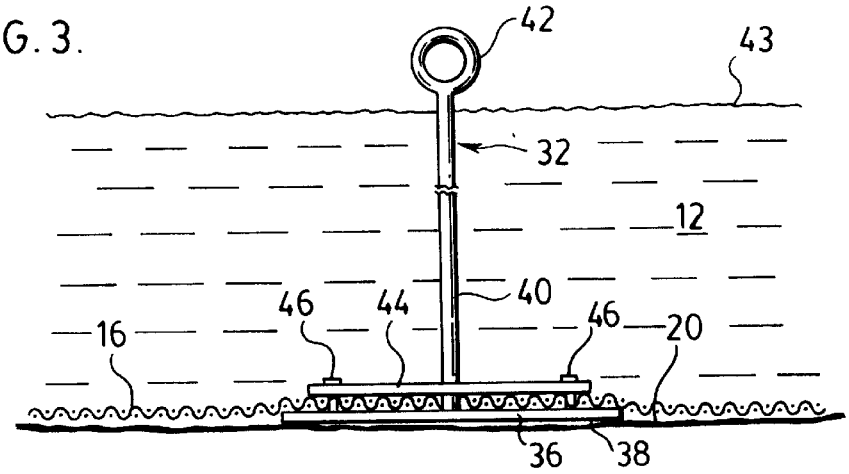
FIG. 3 shows an enlarged perspective side view of a coupling rod used in the apparatus shown in FIG. 1.

FIGS. 1 to 3 show the apparatus 10 as further including a coupling rod 32. As will be described hereafter, the coupling rod 32 is used in the coupling of the mesh liner 16 to the lifting assembly 18 for raising and lowering a central portion 34 (FIG. 2) of the mesh liner 16 from and to the juxtaposed position with the pond bottom 20 shown in FIG. 1. The coupling rod 32 is secured to the mesh liner 16 at a position spaced towards the center of the pond 12, and which is remote from the anchored peripheral edge 22. As shown best in FIG. 3, the coupling rod 32 includes a support plate 36 which is approximately 6 to 18" in diameter and which presents a generally flat lower surface 38 for resting on the pond bottom 20. A steel cylindrical post 40 is mounted perpendicularly on the support plate 36. The post 40 extends from the plate 36, through the mesh liner 16 to an uppermost steel ring 42. The vertical post 40 has a preferred length selected so that when the support plate 36 rests on the bottom 20 of the pond 12, the ring 42 locates at a position marginally above the pond surface 43. A disk-shaped clamping plate 44 is positioned over the post 40, sandwiching part of the mesh liner 16 between the support plate 36 and clamping plate 44. The clamping plate 44 is secured to the support plate 36 by inserting threaded fasteners 46 through aligned bores formed in the plates 36,44. It is to be appreciated that clamping part of the mesh liner 16 between the support plate 36 and clamping plate 44 achieves a better distribution of load forces on the mesh liner 16 at the point where the liner 16 is raised and lowered.

FIG. 2 shows the lift assembly 18 for use in the present apparatus 10 as comprising a hydraulically movable lift boom 48 mounted for mobile use on the flatbed of a truck 50, and a hook 52. The hook 52 is pivotally coupled to a movable free end 54 of the lift boom 48, whereby the raising and lowering of the free end 54 vertically raises and lowers the hook 52. The boom 48 is operable to move the free end 54 to a position wherein the hook 52 is positioned immediately above the pond surface 43 to engage the ring 42 of the lifting rod 32, and the raised position shown in FIG. 2.

FIGS. 1 and 2 show the operation of the apparatus 12 in use to clean golf balls, litter, twigs and other such debris 14 from the bottom surface 20 of the pond 12.

As debris 14 accumulates in the pond 12, it settles on the upper surface of the mesh liner 16. To remove the debris 14 from the pond 12, the lift boom 48 is positioned so that the hook 52 locates vertically above the ring 42. The lift boom 48 is then moved so that its free end 54 and the hook 52 move downwardly to the surface 43 of the pond 12 and the ring 42. The hook 52 is then brought into engagement with the ring 42 coupling the lift assembly 18 and coupling rod 32. Once the hook 52 is coupled to the ring 42, the free end 54 of the boom 48 is moved upwardly, lifting the rod 32 and the portion 34 of the mesh liner 16 off of the bottom surface 20.

By raising the end 54 of the lift boom 48, the coupling rod 32, and thereby the central 34 portion of the mesh 16 which is attached thereto may be raised above the pond surface 43 to the position shown in FIG. 2. Preferably, the rod 32 is lifted so that almost the entire mesh liner 16 is lifted above the pond surface 43. More preferably, the central portion 34 of the mesh 16 at the coupling rod 32 is raised above the secured peripheral edge 22 to a sufficient extent so that in the raised position, the mesh liner 16 slopes from the central portion 34 to the secured peripheral edge 22. In this position, any debris 14 which has accumulated on the mesh 16 either moves under gravity, or may be easily blown, washed by high pressure water spray or swept to the edge 22. Alternately, the lift assembly 18 may be provided with a vibrator (not shown) which imparts vibratory movement to the hook 52 to vibrate the raised mesh 16 and assist in movement of the debris 14 towards the edge 22 and pond banks 24.

It is to be appreciated that on moving the mesh 16 between the raised position shown in FIG. 2 and the submerged position shown in FIG. 1, the mesh openings 30 permit the mesh 16 to pass substantially unobstructed through the water. The sizing of the opening 30 further prevents the debris 14 which has collected on the mesh liner 16 from moving through the openings 30 as the liner 16 is raised where it may otherwise remain in the pond 12. Once the debris 14 moves from the raised central portion 34 to the anchored peripheral edge 22, it may be collected and removed by groundskeepers from the pond banks 24, without necessitating the use of divers or emersion into the pond.

After the debris 14 has been collected and removed from the mesh 16, the free end 54 of the boom 48 is lowered, lowering the hook 52 vertically to reposition the support plate 36 of the coupling rod 32 on the pond bottom 20. As the coupling rod 32 is lowered, the weight of the mesh 16 causes it to return under its own weight to the submerged position shown in FIG. 1, substantially in overlying juxtaposition with the pond bottom 20.

It is envisioned that in addition to facilitating the retrieval of lost golf balls and the cleaning of the pond 12, periodic raising and lowering of the mesh liner 16 will advantageously disrupt sedimentation on the pond bottom 20. This periodic disruption, in turn will discourage both the habitation of the pond 12 by large reptiles as well as plants from taking root, ultimately reducing unwanted plant growth in the pond 12.

It is to be appreciated that providing the vertical post 40 with a length selected so that the ring 42 rests above the pond surface 43 facilitates the connection of the ring 42 and the lifting assembly hook 52. The invention is not, however, so limited. If desired, the post 40 could have a length selected so that when support plate 36 rests on the pond bottom 20, the ring 42 is fully or partially submerged. Similarly, while the use of a ring structure facilitates coupling to the lift boom, other configurations of connectors are also possible and will now become apparent, including the use of hooks and the like. Although not shown, to create a more aesthetically pleasing appearance, the ring 42 could further be either provided with ornamentation, or incorporated as part of a water statue or other ornamental feature.

Figure 5:
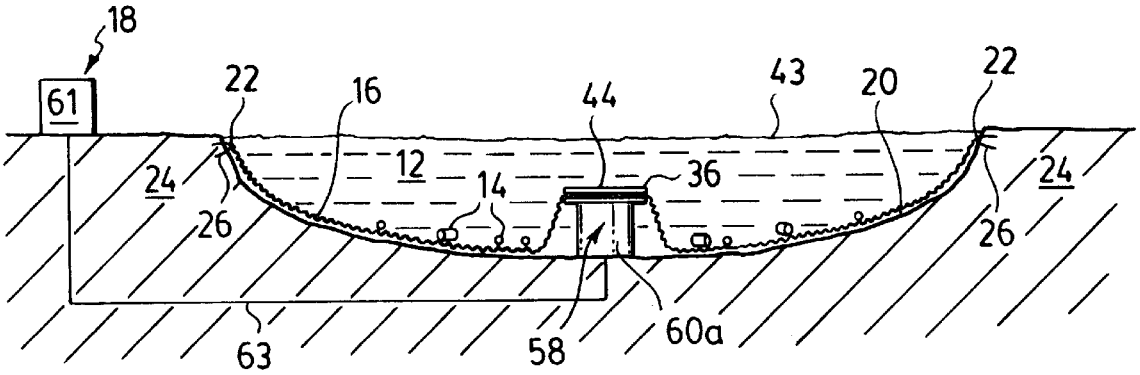
FIG. 5 shows a partial side view of an apparatus for maintaining the bottom of a golf course pond free of debris in accordance with a second embodiment of the invention, with the mesh liner moved to a fully submerged position.
Figure 6:
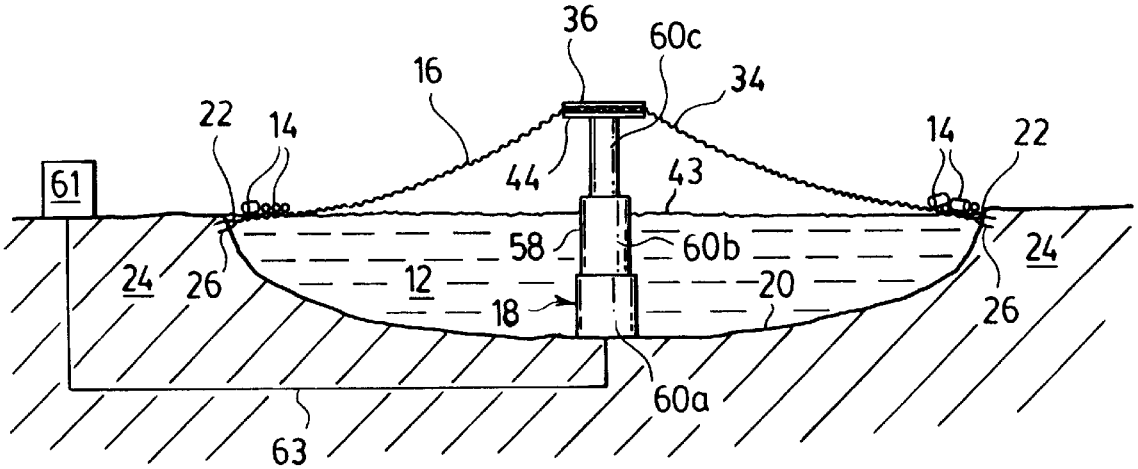
FIG. 6 shows the apparatus of FIG. 5 with the mesh liner moved to a fully raised position suspended above the pond surface.

While FIGS. 1 and 2 disclose the use of a coupling rod 32, lift boom 48 and hook 52 as the mechanism for raising and lowering the central portion 34 of the mesh 12, the invention is not so limited. FIGS. 5 and 6 show an alternate embodiment of the invention where like reference numerals are used to identify like components.

In FIGS. 5 and 6, the lift assembly 18 consists of a hydraulically operable (or alternately pneumatically or mechanically operable) telescoping lift 58 and a remote control unit 61. The lift 58 includes three telescoping sections 60*a*,60*b*,60*c* (FIG. 6) and is operated by the remote control unit 61 which controls the movement of the sections 60 by submerged cable 63. The telescoping sections 60*a*, 60*b*,60*c* are positioned towards the center of the pond 12 for use in raising and lowering the mesh liner 16 in the pond 12. Although not essential, the central portion 34 of the mesh 16 is preferably coupled to at least telescoping section 60*c* which may, for example, include equivalent sandwiching support and clamping plates 36,44 to better distribute tensile stresses on the mesh 16 as it is raised and lowered.

FIG. 5 shows the lift assembly 18 with the telescoping sections 60 in a fully retracted position, and wherein the mesh liner 16 is in a submerged position beneath the surface of the pond 12.

In an extended position shown in FIG. 6, the telescoping sections 60*b*,60*c* are raised relative to section 60*a*. As the sections 60*b*,60*c* are extended, section 60*c* carries with it the central portion 34 of the mesh liner 16. As with the embodiment shown in FIGS. 1 and 2, the central portion 34 of the mesh liner 16 is raised above the pond surface 43, so that substantially all of the mesh 16 is moved above the anchored peripheral edge 22, and that any debris 14 collected on the mesh 16 will move towards the pond banks 24. As with the embodiment shown in FIGS. 1 and 2, once the mesh 16 is moved to the fully raised position, brushes, blowers and/or high pressure hoses may be used to assist in moving the collected debris 14 towards the secured peripheral edge 22.

To return the mesh liner 16 to the fully submerged position, the controller 61 is used to retract the telescoping sections 60*b*,60*c*, and the mesh liner 16 is permitted to settle under its own weight onto the pond bottom 20.

Figure 7:
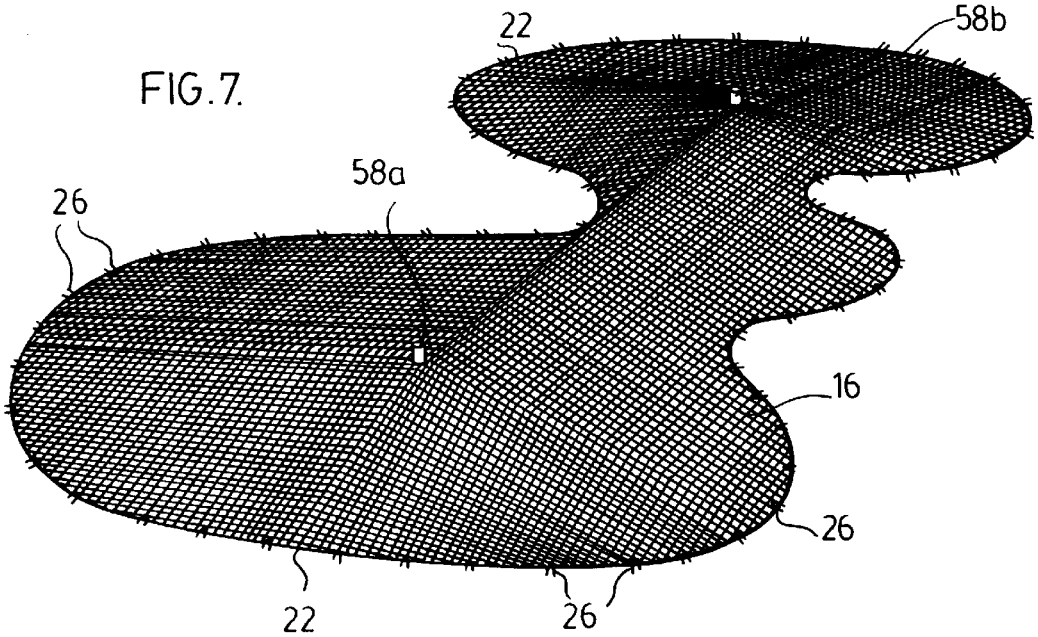
FIG. 7 shows an apparatus for maintaining the bottom surface of a golf course pond free of debris and in accordance with a third embodiment of the invention.

Although the embodiments of the invention described with reference to FIGS. 1 to 6 illustrate the invention as including a single coupling rod 32 or telescoping lift 58 used to raise the mesh 16, the invention is not so limited. FIG. 7 shows an alternate embodiment of the invention in which like reference numerals are used to identify like components.

FIG. 7 shows the use of the apparatus 10 on a larger, and more irregular shaped pond 12, wherein a number of telescoping lifts 58*a*,58*b* are used to raise and lower the mesh liner 16. The telescoping lifts 58*a*,58*b* are essentially identical to that described with reference to FIGS. 5 and 6 and are spaced from the anchored peripheral edge 22 of the mesh liner 16 towards the center of the pond. The telescoping sections of each lift assembly 58*a*,58*b* may be either sequentially or simultaneously extended to lift part or substantially all of the mesh 16 above the pond surface to remove any accumulated debris 14 from the pond bottom 20.

Figure 8:
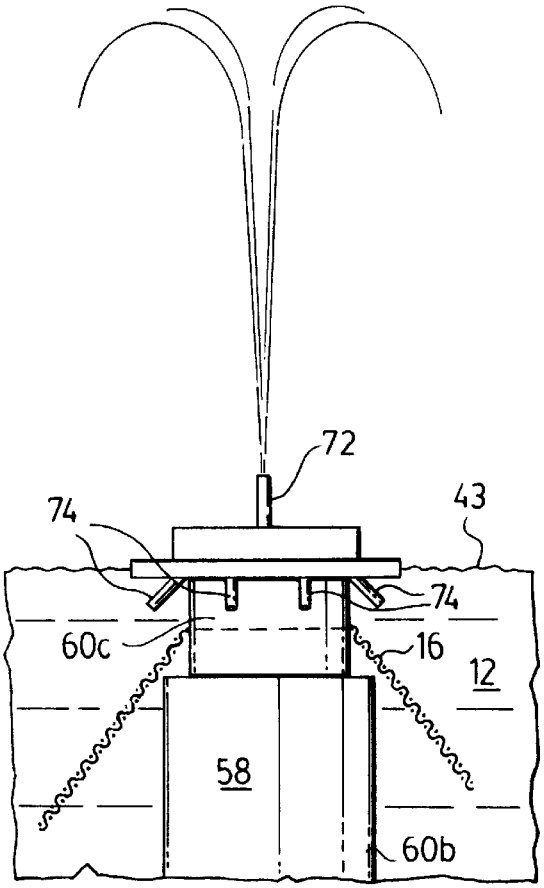
FIG. 8 shows an enlarged side view of a modified lifting mechanism for use in the apparatus of FIG. 5 in a retracted position.
Figure 9:
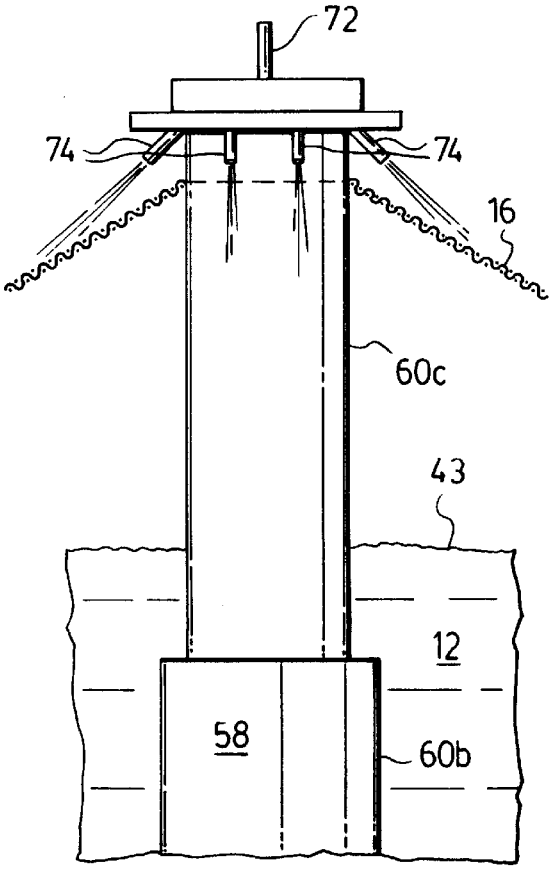
FIG. 9 shows a side view of the lifting apparatus of FIG. 8 in a fully raised position.

In a more elaborate construction shown in FIGS. 8 and 9, the telescoping lift 58 carries with it a fountain assembly 70. In such an embodiment, the lift 58 includes a conventional fountain head 72 which operates as a conventional pond fountain when the telescoping sections 60*b*,60*c* are retracted as is shown in FIG. 8. When the sections 60*b*,60*c* are extended, as is shown in FIG. 9, a valve (not shown) is operated to divert the fountain water spray to secondary water outlets 74. The outlets 74 are positioned radially about the upper end of the section 60*c*. The outlets 74 direct water spray onto the upper surface of the mesh liner 16 to assist in moving the debris 14 thereon to the peripheral edge 22.

Although the preferred embodiment of the invention discloses the use of V or U-shaped anchors 26 as used to secure the edge 22 of the mesh liner 16 in place, the invention is not so limited. Numerous other anchoring structures are also possible and will now become apparent. By way of non-limiting examples, suitable anchors used to secure the peripheral edge 22 of the liner 16 would include pavers, spikes and the like.

Although the preferred embodiment of the invention discloses the coupling of part of the mesh 16 in a sandwiched configuration between the support plate 36 and the clamping plate 44, other mesh supporting structures may also be used. By way of one non-limiting example, support wires may be positioned underneath the mesh 16 extending from the secured edges 22 to the central portion 34 of the liner 16 which is to be directly raised and lowered by the lift assembly 18. In lifting the mesh liner 16, the support wires would operate to cradle the mesh liner 16 and reduce the likelihood that it may tear under its own weight.

Although FIG. 1 shows a pivoting lift boom 48 as raising and lowering the hook 52, the invention is not so limited. If desired, the lift boom 48 could be rigidly mounted, and the hook 52 could be raised or lowered by a series of wires and pulleys coupled to the boom 48.

FIGS. 1 to 9 describe the use of the apparatus on a golf course pond 12. It is to be appreciated, however, that the present invention is equally suitable for use in pools, water fountains, wishing wells, streams and other water bodies where the accumulation of litter and the like poses a problem.

While the use of V or U-shaped anchors 26 permits the simplified securement of the peripheral edge 22, the invention is not so limited. If desired, the edge of the liner 16 could be retained by placing weighted pavers on the edge 22, or alternately, by the use of rope and/or wire.

Although the disclosure describes and illustrates preferred embodiments of the invention, it is not so limited. Many variations and modifications will now occur to those skilled in the art. For a definition of the invention, reference is made to the appended claims.

I claim:

1. A golf ball retrieval apparatus for maintaining a bottom surface of a golf course pond or stream in a substantially debris free state, comprising, a flexible mesh sized to overlie at least part of said bottom surface, said mesh being characterized by openings having a size which permit substantially unrestricted flow of water therethrough while substantially preventing the passage of golf balls therepast, hold down means for securing an edge portion of said mesh adjacent to an edge of said pond or stream, a telescoping lifting mechanism mounted on said bottom surface towards a central area of such pond or stream, the lifting mechanism being selectively operable between collapsed and extended configurations to move a remote portion of said mesh spaced from said edge portion, between a submerged position wherein said mesh is substantially in juxtaposition with said bottom surface when said lifting mechanism is collapsed, and a raised position when said lifting mechanism is extended, and wherein said remote portion of said mesh is raised vertically from said pond or stream to a height to permit golf balls which accumulate on the mesh to be moved away from the raised remote portion in a direction towards the mesh edge portion.

2. An apparatus as claimed in claim 1 wherein said apparatus further includes a coupling member secured to said remote portion of said mesh for coupling said mesh to said lifting mechanism, and said lifting mechanism being hydraulically or pneumatically operable.

3. An apparatus as claimed in claim 1 wherein said telescoping lifting mechanism is hydraulically operable.

4. An apparatus as claimed in claim 1 wherein said mesh overlies substantially all of said bottom surface, and said hold down means secures said mesh edge portion along substantially the entire edge of said pond or stream.

5. An apparatus as claimed in claim 4 wherein said hold down means is selected from the group consisting of an anchor, a spike and paver.

6. An apparatus as claimed in claim 1 wherein said mesh is formed from a corrosive resistant material selected from the group consisting of resistive corrosive metals, stainless steel, rubber, nylon and plastic.

7. An apparatus as claimed in claim 1 wherein when said remote portion is raised to the raised position, substantially all of said mesh is positioned above said pond or stream.

8. An apparatus as claimed in claim 1 wherein said lifting mechanism comprises part of a fountain assembly and wherein when said lifting mechanism is in said collapsed orientation, said fountain assembly provides a fountain stream into said pond or stream.

9. A golf course water hazard liner for maintaining a bottom surface of a water hazard substantially free of golf balls, comprising, a flexible mesh sized to overlie at least part of said bottom surface, wherein said mesh is characterized by mesh openings having a size which permit substantially unrestricted movement of water therethrough while preventing the passage of golf balls therethrough, said mesh having a peripheral edge portion permanently secured adjacent to an edge of said water hazard, at least one telescoping lifting mechanism spaced towards a central area of said pond or stream, the lifting mechanism operable to move a remote portion of said mesh which is spaced from said edge portion between a submerged position wherein said mesh is substantially in juxtaposition with said bottom surface, and a raised position wherein said remote portion is raised vertically relative to said edge portion sufficiently to lift substantially all of the mesh from the water and wherein said telescoping mechanism being movable between a collapsed orientation wherein said mesh is moved to said submerged position and an extended orientation wherein said mesh is moved to said raised position.

10. An apparatus as claimed in claim 9 wherein said peripheral edge portion is secured by hold down means selected from the group consisting of anchors, spikes and pavers.

11. An apparatus as claimed in claim 9 wherein said mesh overlies substantially all of said bottom surface and said edge portion of said mesh is secured along substantially the entire edge portion of said water hazard.

12. An apparatus as claimed in claim 9 wherein said mesh is formed from a corrosive resistant material selected from the group consisting of corrosive resistive metals, stainless steel, rubber, nylon and plastic.

13. A method of maintaining a bottom surface of a golf course water hazard free of golf balls, weeds or litter by the use of a liner comprising, a flexible mesh sized to overlie at least part of said bottom surface, said mesh being characterized by openings having a size which permit substantially unrestricted flow of water therethrough while substantially preventing the passage of golf balls therepast, an edge portion of said mesh being secured adjacent to an edge of said water hazard, telescoping lifting mechanism disposed on said bottom surface and movable between a collapsed orientation and an extruded orientation, the movement of the lifting mechanism from the collapsed to the extended orientation moving a remote portion of said mesh which is spaced from said edge portion between a submerged position where said mesh is substantially in juxtaposition with said bottom surface, and a raised position where said remote portion is raised vertically above said pond or stream to a height to permit any golf balls accumulating on the surface of the mesh to move from the raised remote portion towards the edge portion, said method comprising the steps of:

activating said lifting mechanism to move said remote portion of said mesh to said raised position, removing any golf balls which accumulate towards the edge portion, and activating said lifting means to lower said remote portion of said mesh to said submerged position substantially in juxtaposition with said bottom surface.

14. The method of claim 13 comprising the further step of pressure spray cleaning said mesh while said remote portion is in said raised position.

15. The method of claim 13 comprising the further step of vibrating said mesh while said remote portion is in said raised position.

16. An apparatus for maintaining a bottom surface of a pond or stream in a substantially debris free state, comprising, a flexible mesh formed from a corrosive resistant material selected from the group consisting of corrosive resistive metals, stainless steel, rubber, nylon and plastic, and sized to overlie at least part of said bottom surface, said mesh being characterized by openings having a size which permit substantially unrestricted flow of water therethrough while substantially preventing the passage of golf balls therepast, hold down means for securing an edge portion of said mesh adjacent to an edge of said pond or stream,lifting means for selectively raising a remote portion of said mesh spaced from said edge portion, between a submerged position wherein said mesh is substantially in juxtaposition with said bottom surface, and a raised position wherein said remote portion of said mesh is raised vertically from said pond or stream to a height to permit debris which has accumulated on the mesh to be moved away from the raised remote portion in a direction towards the mesh edge portion, said lifting means comprising part of a fountain assembly and including a telescoping member secured to said remote portion, said telescoping member being movable between a collapsed orientation wherein said mesh is moved to said submerged position and an extended orientation wherein said mesh is moved to said raised position, and wherein when said telescoping member is in said collapsed orientation, said fountain assembly provides a fountain stream into said pond or stream.

* * * * *